US011738981B2

(12) United States Patent
Mercier et al.

(10) Patent No.: US 11,738,981 B2
(45) Date of Patent: Aug. 29, 2023

(54) CONTAINER FILL STATION

(71) Applicant: Wild Goose Canning Technologies, LLC, Louisville, CO (US)

(72) Inventors: Michael Mercier, Louisville, CO (US); Alexis Foreman, Louisville, CO (US); Paul Wells, Louisville, CO (US); Dan Moody, Louisville, CO (US); Adam McKim, Louisville, CO (US); Josh Halvorsen, Louisville, CO (US); Jace Pivonka, Louisville, CO (US); John Bickers, Louisville, CO (US); Tyler Nickerson, Louisville, CO (US)

(73) Assignee: Wild Goose Canning Technologies, LLC, Louisville, CO (US)

( * ) Notice: Subject to any disclaimer, the term of this patent is extended or adjusted under 35 U.S.C. 154(b) by 0 days.

(21) Appl. No.: 17/527,644

(22) Filed: Nov. 16, 2021

(65) Prior Publication Data

US 2022/0153566 A1 May 19, 2022

Related U.S. Application Data

(60) Provisional application No. 63/240,390, filed on Sep. 3, 2021, provisional application No. 63/115,364, filed on Nov. 18, 2020.

(51) Int. Cl.
*B67C 3/26* (2006.01)
*B67C 3/28* (2006.01)
(Continued)

(52) U.S. Cl.
CPC ..... *B67C 3/26* (2013.01); *B65B 3/18* (2013.01); *B67C 3/04* (2013.01); *B67C 3/286* (2013.01);
(Continued)

(58) Field of Classification Search
CPC .. B67C 3/26; B67C 3/04; B67C 3/286; B67C 2003/2602; B67C 2003/2654; B67C 2003/2657; B65B 3/04; B65B 3/18
See application file for complete search history.

(56) References Cited

U.S. PATENT DOCUMENTS 2,794,455 A * 6/1957 Day ..... B65B 3/26 141/234
2,813,555 A * 11/1957 Douglas ..... B67C 3/225 141/308
(Continued)

FOREIGN PATENT DOCUMENTS

EP 3919432 A1 * 12/2021 ..... B67C 3/225
WO WO 2016/013941 A2 1/2016

OTHER PUBLICATIONS

International Search Report and Written Opinion for PCT Application No. PCT/US2021/059326, dated Feb. 24, 2022, 15 pages.

*Primary Examiner* — Nicolas A Arnett
(74) *Attorney, Agent, or Firm* — Crowell & Moring LLP

(57) ABSTRACT

A container fill station includes a seal bar configured to temporarily contact an open end of a container, to temporarily seal an interior of the container from a surrounding atmosphere, a fill head configured to be moved by a fill head actuator through a sealed opening in the seal bar, a fill head valve located in a fluid pathway between a liquid source and the fill head outlet, and an outflowing gas valve in fluid communication with the interior of the container. Therein, control of a liquid fill rate is provided by opening the outflowing gas valve a select amount while simultaneously opening the fill head valve. During a filling operation method, the interior of the container may be temporarily sealed and pressurized, or filling may be done at ambient/atmospheric pressure, preferably with the fill head outlet being disposed below the liquid's surface during filling.

6 Claims, 15 Drawing Sheets

(51) Int. Cl.
*B67C 3/04* (2006.01)
*B65B 3/18* (2006.01)

(52) U.S. Cl.
CPC ..... *B67C 2003/2602* (2013.01); *B67C 2003/2654* (2013.01); *B67C 2003/2657* (2013.01)

(56) References Cited

U.S. PATENT DOCUMENTS

| | | | | | |
|---|---|---|---|---|---|
| 2,839,094 | A * | 6/1958 | Reno | B67C 3/2637 | 141/351 |
| 3,830,265 | A * | 8/1974 | Matejek | B67C 3/26 | 137/170.1 |
| 4,436,124 | A * | 3/1984 | Borstelmann | B67C 3/10 | 141/37 |
| 5,042,536 | A * | 8/1991 | Petri | B67C 3/06 | 141/147 |
| 5,145,008 | A * | 9/1992 | Yun | B67C 3/06 | 141/147 |
| 5,150,740 | A * | 9/1992 | Yun | B67C 3/2628 | 141/46 |
| 8,517,065 | B2 * | 8/2013 | Conforti | B67C 3/22 | 141/146 |
| 9,714,161 | B2 * | 7/2017 | Riggio | B67C 3/282 | |
| 11,078,064 | B2 * | 8/2021 | Massari | B67C 3/045 | |
| 2013/0240081 | A1 * | 9/2013 | Balzarin | B67C 3/225 | 141/7 |
| 2016/0368751 | A1 * | 12/2016 | Fickert | B67C 3/286 | |
| 2019/0010039 | A1 * | 1/2019 | Clusserath | B67C 3/287 | |
| 2020/0002147 | A1 * | 1/2020 | Jones | B67C 3/10 | |
| 2021/0253411 | A1 * | 8/2021 | Nishino | B67C 3/286 | |
| 2021/0380386 | A1 * | 12/2021 | Franceschini | B67C 3/2617 | |

* cited by examiner

CONTAINER FILL STATION

CROSS-REFERENCE TO RELATED APPLICATIONS

This application claims priority to U.S. Provisional Patent Application Ser. Nos. 63/115,364, filed Nov. 18, 2020, and 63/240,390, filed Sep. 3, 2021, each of which is incorporated herein by reference in its entirety.

FIELD OF THE INVENTION

The embodiments disclosed herein relate to a container fill station. More specifically, the embodiments relate to a fill station configured to fill a container with a beverage or another liquid.

BACKGROUND OF THE INVENTION

A variety of apparatus are presently available to wholly or partially automate or minimize the labor associated with the process of filling a container with the liquid. A representative container may, for example, be a can or bottle. The liquid may, for example, be a beverage. Known container filling apparatus may be relatively slow, or if not slow, relatively expensive. In addition, known container filling apparatus may not provide a sufficient level of control over filling operations to assure an accurate and repeatable fill, and assure the integrity of the beverage or other liquid placed into the container.

The container fill station disclosed herein overcomes one or more of these or other problems.

DETAILED DESCRIPTION OF THE EMBODIMENTS

Figure 1:
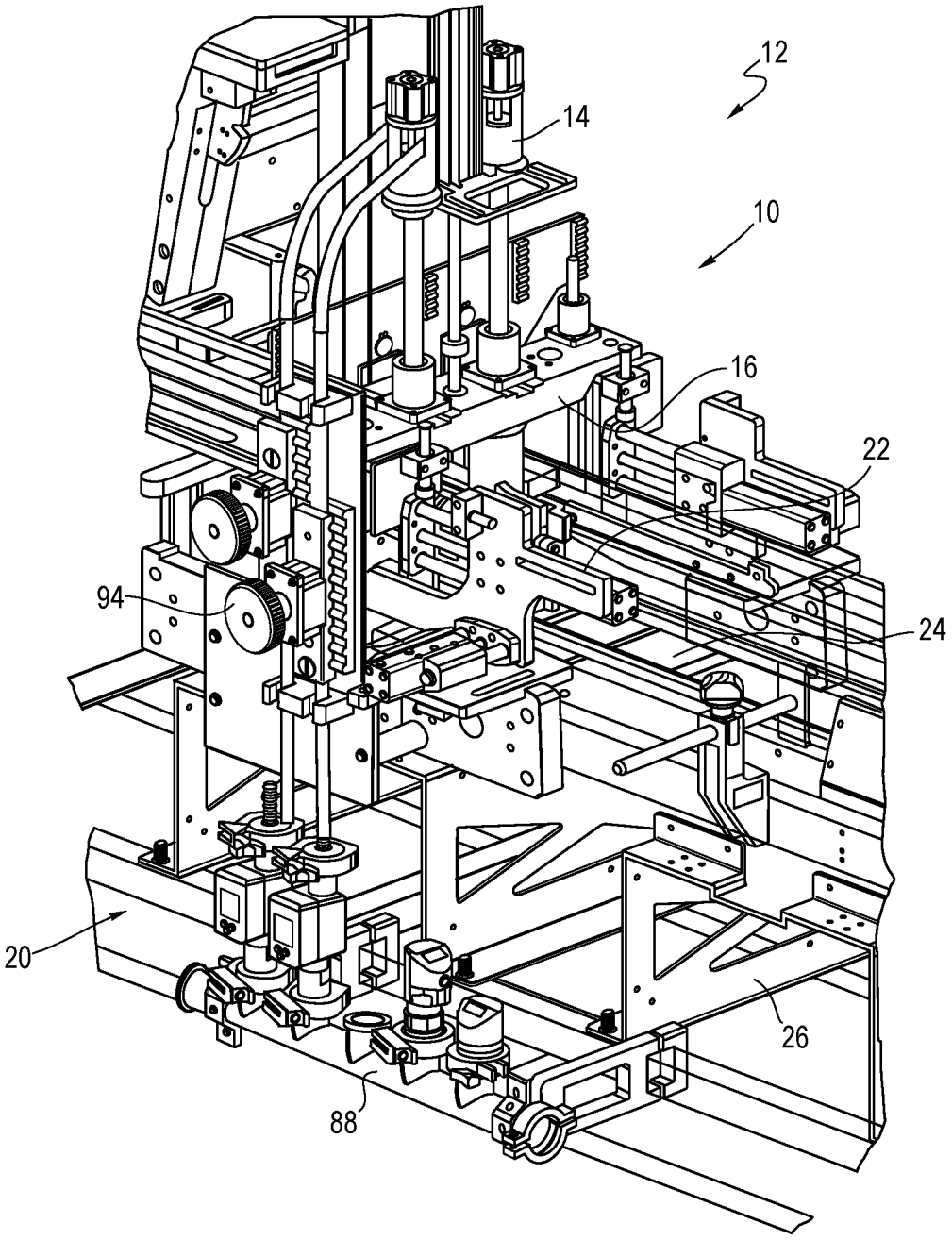
FIG. 1 is a perspective view of a container fill station as described herein.

In the following description, for the purposes of explanation, numerous specific details are set forth to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about," as that term would be understood to encompass standard mechanical tolerances and variations as known in the art. The phrase "configured to" is expressly used to describe specific construction features that must perform a specified function, maintain a specified shape, and/or move or otherwise operate within the manner clearly described as it would be understood by a person of skill in the relevant art of beverage container filling and/or sealing machines and similar mechanical arts. In this application, the use of the singular includes the plural unless specifically stated otherwise and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

One embodiment disclosed herein is a container fill station 10. The container fill station 10 may also be referred to as a fill station 10. The fill station 10 may be implemented as a module or component of a larger container fill system 12 having other stations or modules including but not limited to a container lid applicator, lid sealing station (e.g. by seaming or other sealing means), labeling station and packaging station. Together, the various stations of a container fill system 12 may be used to fill a container with a beverage or other liquid, seal or otherwise close the open top of the container, apply labels to the exterior of the container and otherwise prepare filled containers for distribution. In the illustrated embodiments, the container fill system 12 is configured to fill a metal can with beverages. As used herein however, the term "container" includes but is not limited to a can, bottle, plastic container, jar, tub, or similar vessel. The containers may be filled with any liquid or beverage including but not limited to water, beer, wine, alcoholic beverages, soft drinks, juices, other beverages. In alternative embodiments a container may be filled with industrial liquids, cleaning liquids, household liquids, or liquids of any sort.

Figure 2:
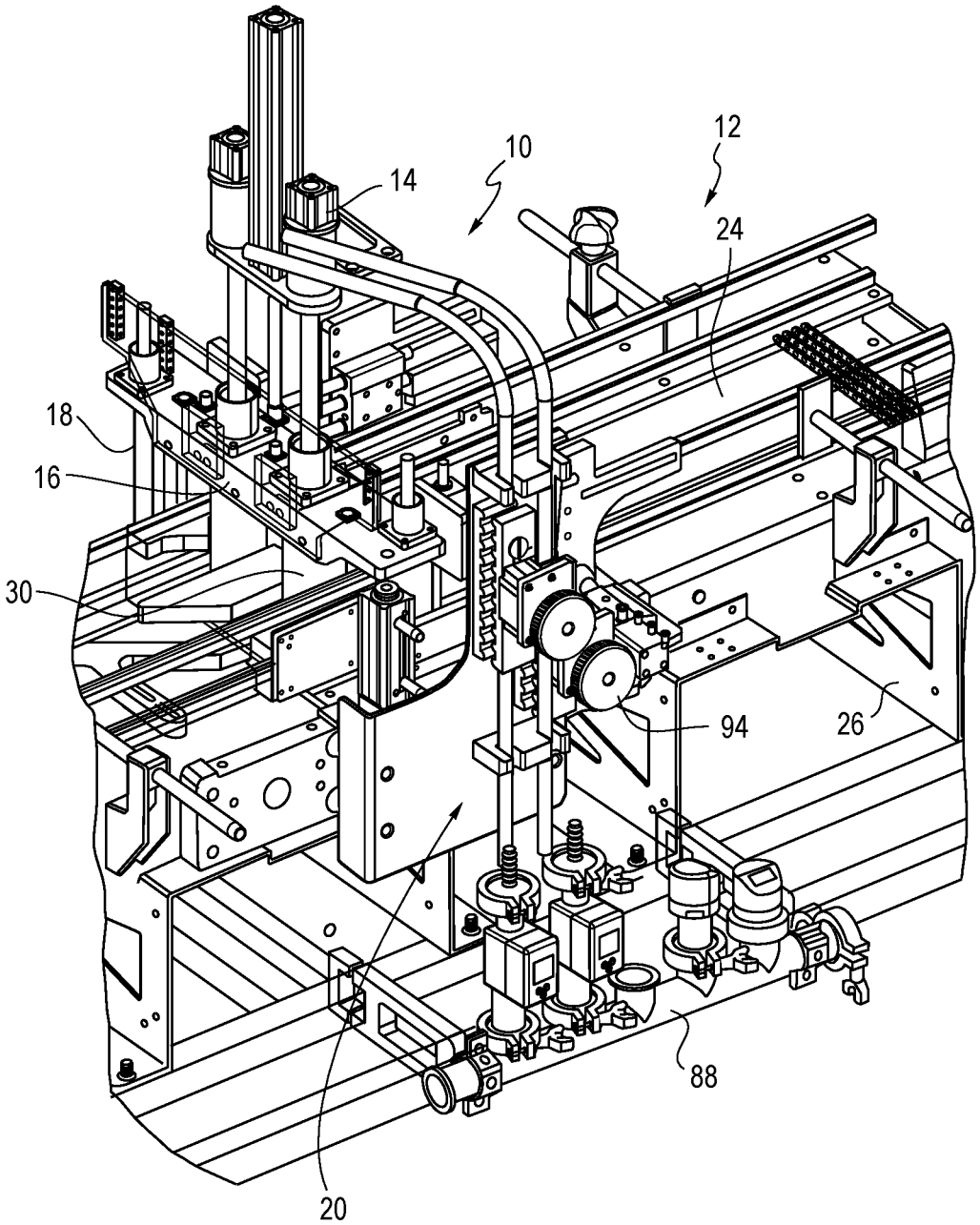
FIG. 2 is an alternative perspective view of the container fill station of FIG. 1

As shown in FIGS. 1 and 2, a container fill station 10 may include a fill head system 14, a seal bar 16 supported by a seal bar gantry 18 and a flow control system 20. Each of these subsystems is described in greater detail herein. A container fill station 10 may also include container transfer apparatus 22 and a modular deck 24 or conveyor system configured to transport containers through the fill station 10. The fill station 10 and/or selected modules of a container fill system 12 may be supported on a stand 26 or a carriage. In certain embodiments the stand 26 will include wheels, casters, or similar apparatus providing for the fill station 10 or the fill system 12 to be readily moved around a facility and/or from one facility to another.

The container fill station 10 functions to accurately and repeatably fill a container prior to the container being sealed, while maintaining the integrity and characteristics of the beverage or other liquid placed into the container. In certain embodiments, the various subsystems of the fill station 10 create a counter-pressure fill station that provides certain advantages as noted below, while the fill station can be used with a sealed/pressurized configuration, or an unsealed configuration where the beverage or other liquid is at atmospheric pressure.

As shown in FIGS. 3-7, certain embodiments of the fill station 10 include a seal bar 16 supported by a seal bar gantry 18. The seal bar 16 may be brought into contact with the open top 28 of an empty container 30 to temporarily seal the open top 28 during fill operations. Alternatively, the empty container 30 may be brought into contact with the seal bar 16 to temporarily seal the open top 28 of the container 30. If desired, the open end 28 of the container 30 can remain open to maintain ambient/atmospheric pressure during an operation of the fill station 10. After the empty container 30 is filled with a beverage or other liquid, the seal bar 16 may be separated from contact with the open top 28 and the filled container may then be transported to another station, for example a lid dropper station where a container top is applied and/or sealed (e.g., by seaming). As used herein, the terms ambient pressure, atmospheric pressure, or ambient/atmospheric pressure are used to refer to the air pressure in the location where a container is being filed, which generally will be associated with the immediately local barometric pressure.

In the embodiments shown in FIGS. 3-7 the seal bar 16 is configured to contact and temporarily seal two containers 30 at one time. It is important to note that alternative embodiments may include a seal bar 16 configured to contact one container or any number of containers, limited only by the size of the seal bar 16. In an embodiment where the seal bar 16 contacts several containers, for example 4, 6, 8, 10, 12, or more containers simultaneously, the seal bar will typically be formed in a rectangular or square shape when viewed from the top, although still referred to herein as a seal bar. In addition, a fill system 12 or fill station 10 may include multiple instances of separate seal bars 16 of any desired size and configuration.

Figure 6:
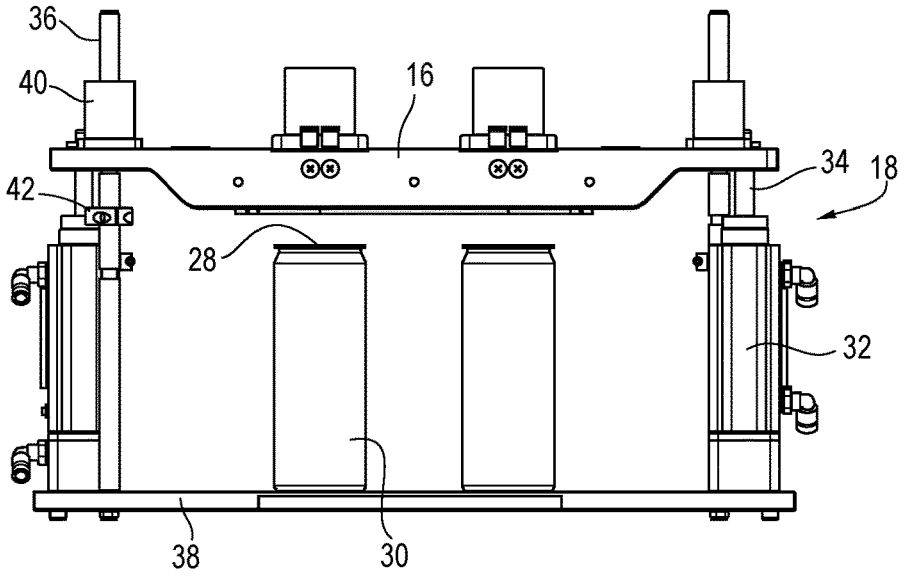
FIG. 6 is a front elevation view of a seal bar and seal bar gantry.
Figure 7:
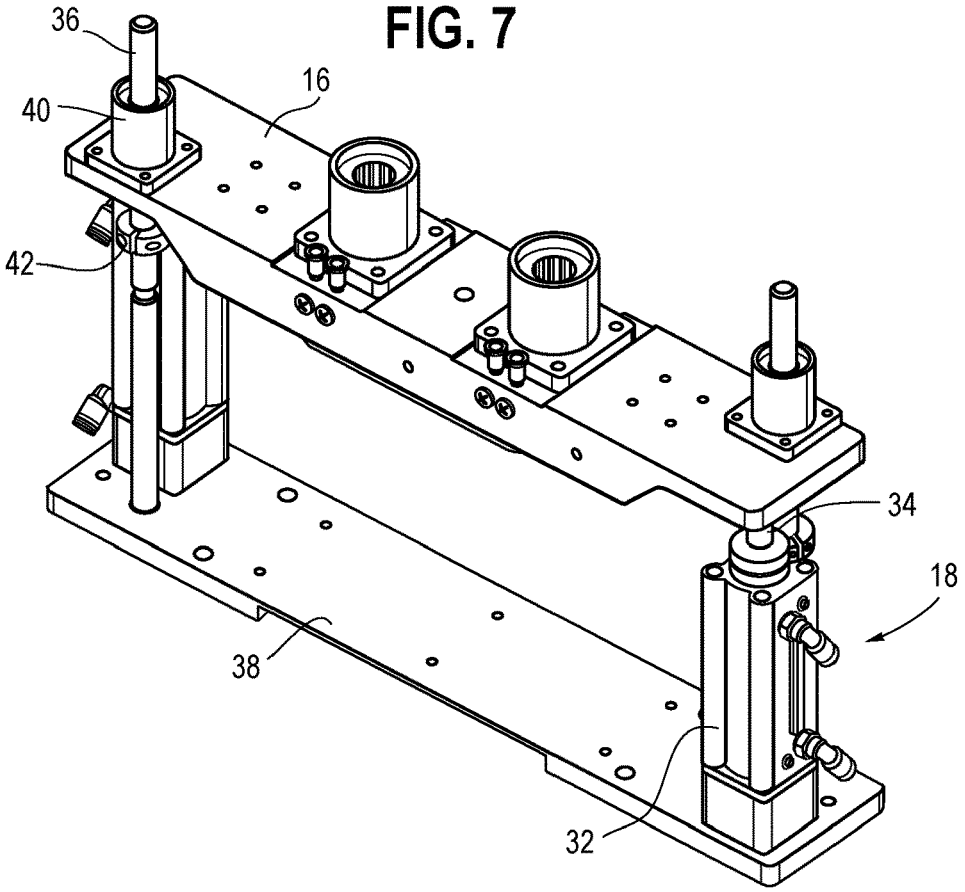
FIG. 7 is a top perspective view of the seal bar and seal bar gantry of FIG. 6.
Figure 8:
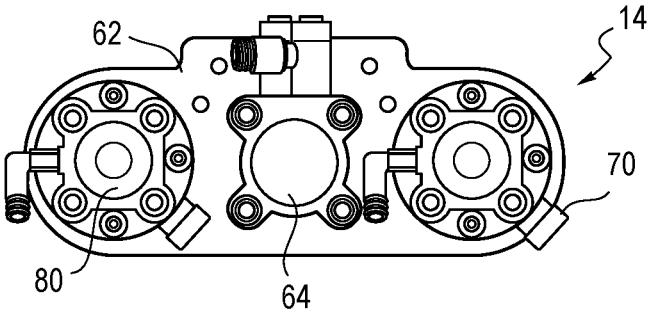
FIG. 8 is a plan view of a fill head system.
Figure 9:
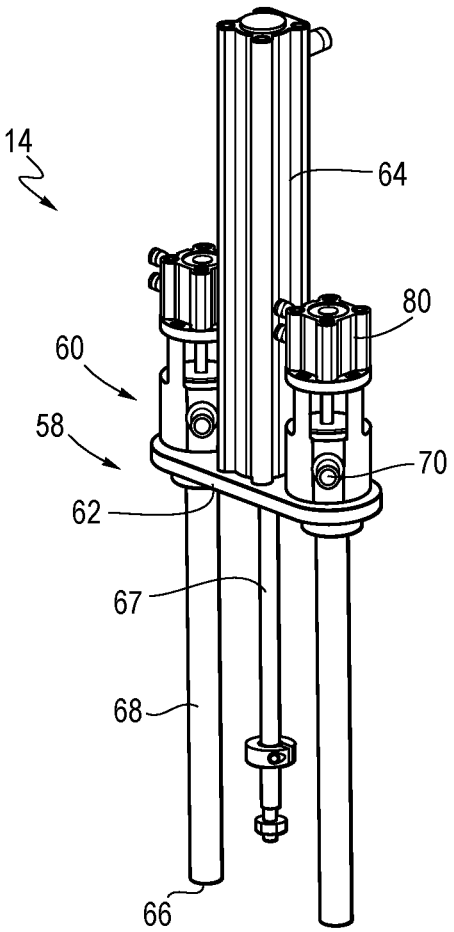
FIG. 9 is a front perspective view of the fill head system of FIG. 8.
Figure 10:
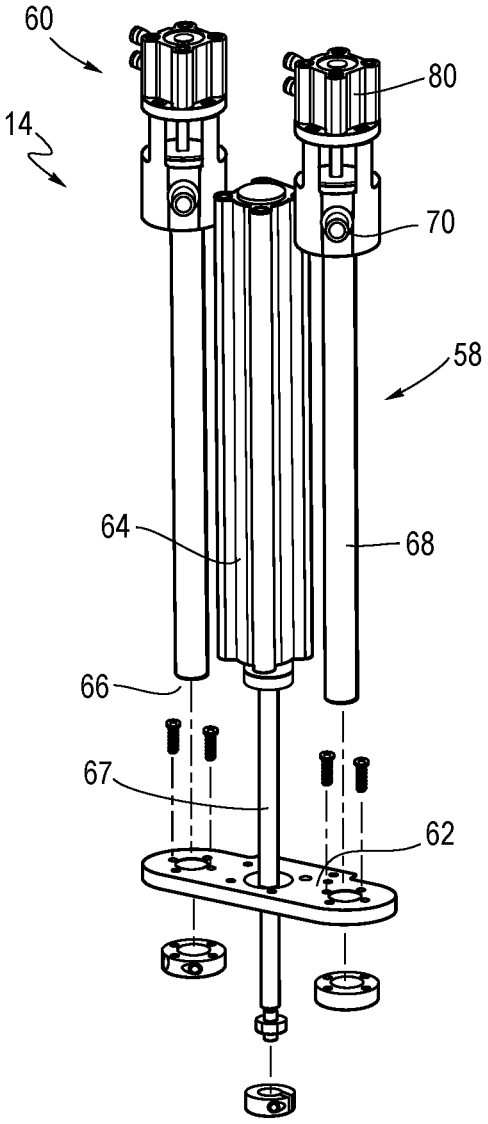
FIG. 10 is an exploded view of the fill head system of FIG. 8.

As is best shown in FIGS. 6 and 7, the seal bar 16 is supported and moved into and out of contact with the open tops 28 of one or more containers 30 by a seal bar gantry 18. The seal bar gantry 18 includes one or more gantry actuators 32 connected with an actuator piston 34 to the seal bar 16. The gantry actuators 32 may be implemented with any sort of actuator that provides for substantially linear motion at the seal bar 16, including but not limited to a pneumatic cylinder actuator, a hydraulic cylinder actuator, a motor-driven linear screw actuator, a motor driven belt/pulley or gear and track assembly, an electromagnetically driven solenoid piston or other known means of providing substantially linear motion over a suitable range.

The seal bar gantry 18 further includes guide rods 36 extending from a gantry base 38. The gantry base 38 will also typically support the gantry actuators 32. The end of each guide rod 36 opposite the gantry base 38 will be received in a corresponding seal bar bushing 40 such that the seal bar 16 may slide along the guide rods 36 within a selected range while the seal bar 16 is maintained substantially perpendicular to the lengths of the guide rods 36. Although FIGS. 6 and 7 show a seal bar gantry 18 having two gantry actuators 32 and two guide rods 36 received in two seal bar bushings 40, alternative embodiments may include any suitable number of these elements necessary to actuate and support an appropriately sized seal bar 16.

The gantry actuators 32 are operated to lower the seal bar 16 into contact with the open tops 28 of empty containers 30 prior to, or at the commencement of, fill operations. In an alternative embodiment, the gantry actuators 32 are operated to raise the gantry base 38 supporting a container 30 into contact with the seal bar 16. The gantry actuators 32 are also operated to separate the seal bar 16 away from contact with the open tops 28 of containers 30 after the containers have been filled with a beverage or other liquid as described herein. In either embodiment, the gantry base 38 provides structural support to withstand the sealing force formed between the seal bar 16 and the container(s) 30. In certain embodiments, the gantry base 38 is positioned above the surface of a conveyor belt or other can transfer apparatus 22 and containers are shuttled off the belt, onto the gantry base 38 and then back onto the conveyor belt or other transfer apparatus 22. Thus, structures may be formed on the lower surface of the gantry base 38 to reduce friction between the gantry base 38 and moving assemblies such as a conveyor belt.

As is best shown in FIG. 6, the guide rods 36 may be implemented with one or more guide rod shaft collars 42 which may be affixed at desired positions along the length of the guide rods 36 to set a lower limit to the motion of the seal bar 16 along the guide rods 36. Alternatively, the one or more guide rod shaft collars 42 may be affixed as desired to set the range of an upward motion of the gantry base 38 and any container 30 placed thereon. In this manner the fill station 10 may be adjusted to accommodate containers 30 having significantly different heights or slightly different heights. Alternatively, mechanical or digital control may be implemented over the stroke of the actuator piston 34 extending from a gantry actuator 32 to set the permitted range of seal bar or gantry base motion.

Figure 3:
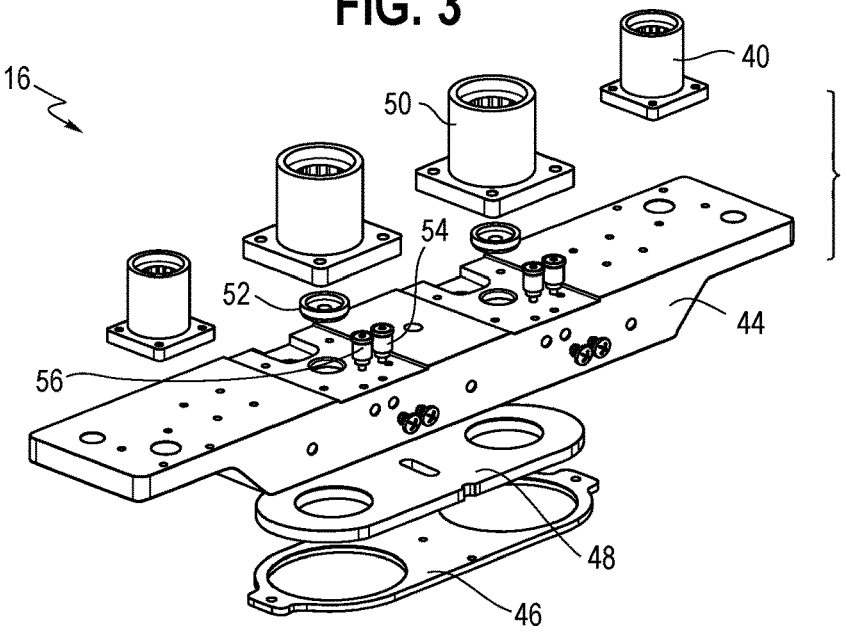
FIG. 3 is an exploded view of a seal bar and ancillary apparatus.

The seal bar 16 includes a seal bar body 44 supporting various operational components. The illustrated seal bar body 44 is a substantially rigid element. Alternatively, a seal bar 16 may be implemented with a flexible seal bar body 44. As is shown in FIG. 3, the seal bar body 44 supports the seal bar bushings 40 described above. In addition, the seal bar body 44 may include a retainer plate 46 securing a seal 48 to the seal bar body 44. These elements are typically positioned on a lower side of the seal bar body 44 which operationally faces the open top 28 of the container 30.

The retainer plate 46 serves to removably secure the seal 48 to the seal bar body 44 in the illustrated embodiments. Alternatively, the seal 48 may be secured to the seal bar body 44 using adhesives, fasteners, mating tabs and receptacles, or other methods. The illustrated retainer plate 46 provides for access to the seal 48 for maintenance or replacement. The retainer plate 46 may be configured to overlap the seal 48 by a select amount to prevent the seal from expanding and deforming to the point of coming free from the seal bar body 44 or disengaging with the open top 28 of a container 30 during fill operations. Alternatively, or in addition to the security provided by the retainer plate 46, a recess or sidewall may be formed in the seal bar body 44 adjacent the perimeter of the seal 48, and/or overlapping the seal 48 to prevent the seal 48 from expanding and deforming to the point of coming free from the seal bar body 44 or disengaging with the open top 28 of a container 30 during fill operations.

The seal 48 is typically implemented with a relatively thin sheet of elastomeric material such as rubber, neoprene, synthetic rubber, or another suitable plastic material. The seal 48 may be formed to have grooves, ridges or other structures designed to couple closely to the open top 28 of a container 30. Alternatively, the seal 48 may be flat surfaced with a fluid tight coupling to the open top 28 of a container 30 being provided by elastic deformation of the seal 48.

As shown in the figures, each of the retainer plate 46 and seal 48 includes openings which are positioned over the interior spaces of corresponding containers 30 during fill operations. As described in detail below, certain portions of the fill head system 14 extend through these openings during fill operations. Corresponding openings are formed in the seal bar body 44. In addition, one or more fill head bearings 50 may be mounted to the seal bar body 44. As described in detail below, the fill head bearings 50 support and guide the fill head system 14 during fill operations. The fill head bearings 50 may be implemented with bushings, linear bearings, ball bearings, or other apparatus providing for support and/or guidance of the fill head system 14 while permitting linear motion as described below. In certain embodiments, the fill head bearings 50 may include a gasket 52 or other sealing element providing a seal between portions of the fill head assemblies and the seal bar 16. In other embodiments the fill head bearings 50 may be designed to inherently provide a suitable seal.

The seal bar body 44 may also support gas inlet ports 54 and gas outlet ports 56 which are utilized during fill operations as described in detail below. The gas inlet ports 54 and gas outlet ports 56 communicate with the openings in the seal 48 positioned above the container 30 through gas flow channels defined within the seal bar body 44. Thus, the gas inlet ports 54 and gas outlet ports 56 are in fluid communication with the interior space of a container 30 when the seal bar 16 is actuated to form a temporary seal with the open top 28 of a container 30, thereby sealing the interior of a container from the surrounding atmosphere. However, it will also be appreciated that an advantage of the present embodiments include an ability to fill the container(s) 30 at ambient pressure—that is the atmospheric pressure in the environment of the fill station 10—by not engaging the seal bar 16 to the container(s). This multifunction aspect provides advantages and flexibility to a user that may have particular value for user-determined carbonated or non-carbonated beverages or other liquids. These may include shorter cycle times and reduced consumption of $CO_2$ and/or other gas being used.

A representative fill head system 14 is shown in FIGS. 8-12. The fill head system 14 serves to channel a beverage or other liquid from a liquid source to a container 30 during fill operations. The liquid source is not shown in the figures but may be, for example, a brewer's brite tank, a fermenter, another type of tank, a carboy, jug, cylinder, or other vessel. The representative fill head system 14 includes a pair of fill heads 58. Each fill head 58 includes an inlet assembly 60. The fill heads 58 are supported by a fill head plate 62. Although the figures show two fill heads 58, it is important to note that a fill head system 14 can be implemented with any desired number of fill heads 58. In many embodiments, the number of fill heads 58 will be equal to the number of openings in the seal 48, which corresponds to the number of containers 30 which will be filled simultaneously.

The fill head plate 62 will typically be attached to a fill head actuator 64. The fill head actuator 64 may be actuated to raise and lower the fill heads 58 with respect to the seal bar 16, and therefore with respect to the containers 30. As noted in more detail below, a fill process may involve positioning a fill head outlet 66 toward the bottom of a container 30 when fill operations are commenced and raising the outlet 66 at a selected rate as a beverage or other liquid is dispensed into the container 30. The fill head actuator 64 raises and lowers the fill head plate 62 and attached fill heads 58 to accomplish movement of the fill head outlet 66 during the dispensing process. Preferably, the fill head outlet 66 remains at or below the level of the surface of the beverage or other liquid with which the container is being filled.

The fill head actuator 64 may be implemented with any sort of actuator that provides for substantially linear motion, including but not limited to a pneumatic cylinder actuator, a hydraulic cylinder actuator, a motor-driven linear screw actuator, a motor driven belt/pulley or gear and track assembly, an electromagnetically driven piston, or other known means of providing substantially linear motion. In the illustrated embodiment, the fill head actuator 64 operates by extending or retracting a rod 67 from the fill head actuator body 64. In certain embodiments, the rod 67 is attached to or engaged with the seal bar body 44. The engagement between the rod 67 and the seal bar body 44 may be adjustable along the length of the rod 67.

A shaft portion 68 of each fill head 58 is supported by a corresponding fill head bearing 50 attached to the seal bar body 44. The shaft portion 68 of a fill head 58 generally extends from the inlet assembly 60 to the fill head outlet 66. The fill head bearings 50 permit the shaft portion 68 to slide lengthwise through the seal bar body 44 while maintaining the fill head plate 62 in a substantially perpendicular orientation with respect to the lengths of the fill head shaft portions 68.

As noted above, the actuator rod 67 is attached to the seal bar body 44. Thus, the fill head actuator 64 can move the fill head assembly 14 up and down with respect to the seal bar. This range of motion is important during the fill process as detailed below. Furthermore, the gantry actuators 32 associated with the seal bar gantry 18 can move the seal bar 16 and fill head assemblies 14 together into and out of contact with the open top 28 of a container 30. This separate range of motion (of the gantry 18) is typically used at the beginning and end of a fill cycle to engage and release a container 30. For atmospheric filling the gantry movement may be omitted from the method, while fill head assembly range of motion will be the same or substantially the same when filing with counterpressure or at ambient/atmospheric pressure.

Figure 11:
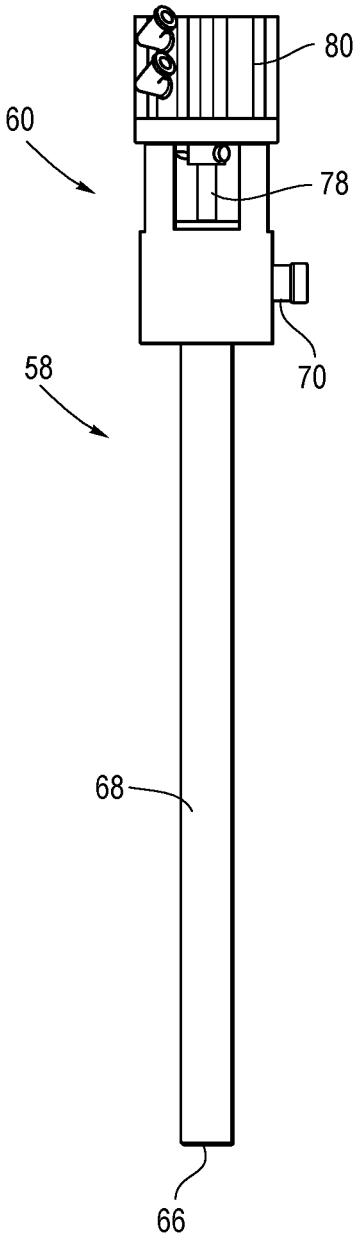
FIG. 11 is a front elevation view of a fill head.
Figure 12:
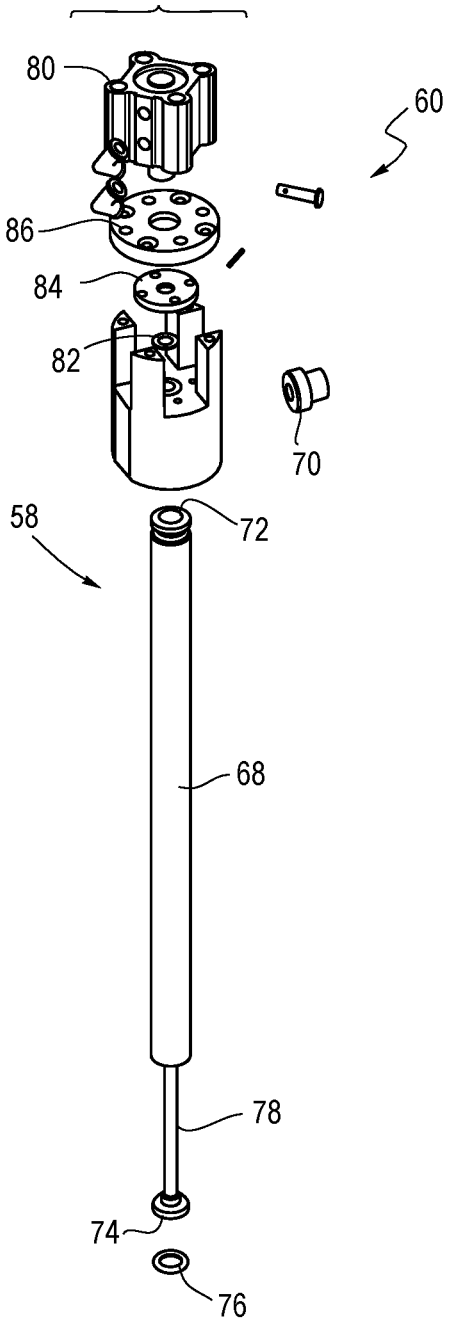
FIG. 12 is an exploded view of the fill head of FIG. 11.

A more detailed view of a single fill head 58 is included in FIGS. 11 and 12. The fill head 58 includes an inlet assembly 60. The inlet assembly 60 includes a connection, for example, hose barb 70 which may be connected to a hose or tube extending from the beverage or liquid source container. The hose barb 70 communicates with a liquid pathway 72 extending through the interior of the shaft portion 68 of the fill head 58 to the fill head outlet 66. In the illustrated embodiment, the outlet 66 may be opened or closed with an outlet valve 74 and outlet seal 76 assembly. The barb 70 communication may be direct or may be via a manifold. The outlet valve 74 is attached to a valve shaft 78 extending upward through the shaft portion 68. The valve shaft 78 may be raised or lowered by a valve control assembly 80. The valve control assembly may be implemented with an electronic solenoid, a pneumatic or hydraulic cylinder or similar apparatus configured to raise and lower the valve shaft 68 an appropriate distance to open or close the outlet valve 74.

The liquid pathway 72 opposite the outlet valve 74 can be sealed above the tube barb 70, for example with a valve shaft seal 82 abutting a retainer plate 84 and valve control assembly mounting plate 86.

During fill operations, a beverage or other liquid is dispensed through one or more fill heads 58 into corresponding containers 30. Care must be taken during fill processes, particularly with carbonated beverages, to avoid unduly disturbing the beverage, overflowing the beverage, foaming the beverage and the like. Thus, it may be advantageous to provide for fine control over beverage or other liquid flow through a fill head 58. This advantage applies both to sealed counterpressure uses and unsealed (ambient/atmospheric pressure) uses of the method and device embodiments described herein, with respect to carbonated and non-carbonated beverages.

As described in detail below, liquid flow control may be accomplished by control over the flow rate of a gas released from the interior of a temporarily sealed container 30 during fill operations. Alternatively, liquid flow control may be provided by directly controlling liquid flow through a fill head 58. In certain embodiments flow control will be provided by controlling both the flow rate of a gas expelled from the interior of a temporarily sealed container 30 in conjunction with control over the flow of a liquid through a fill head 58. Therefore, the flow control system 20 may include aspects of liquid or beverage flow control and gas flow control, each of which complementary systems are described in detail below.

Figure 13:
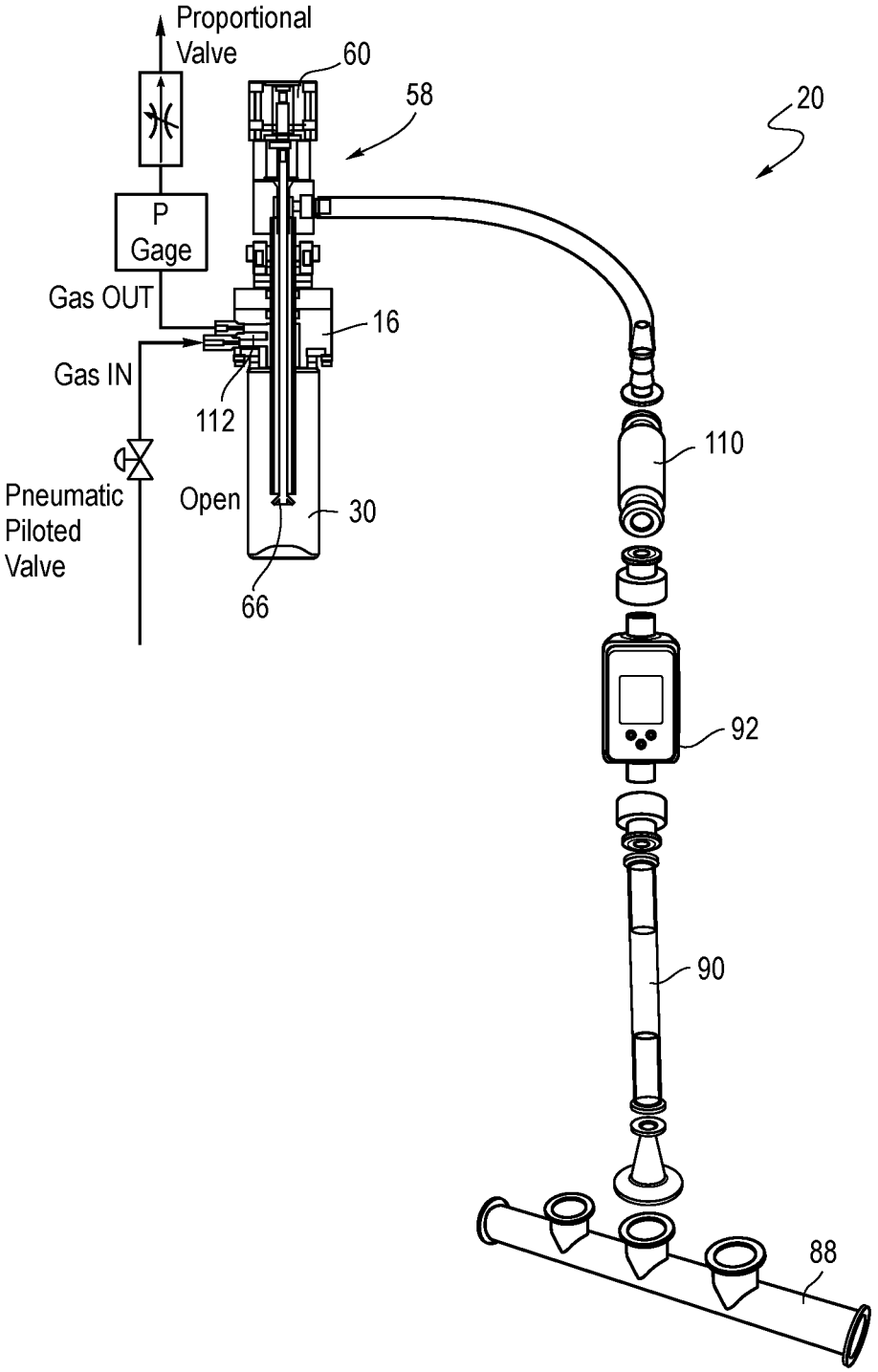
FIG. 13 is a schematic diagram of a flow control system.
Figure 14:
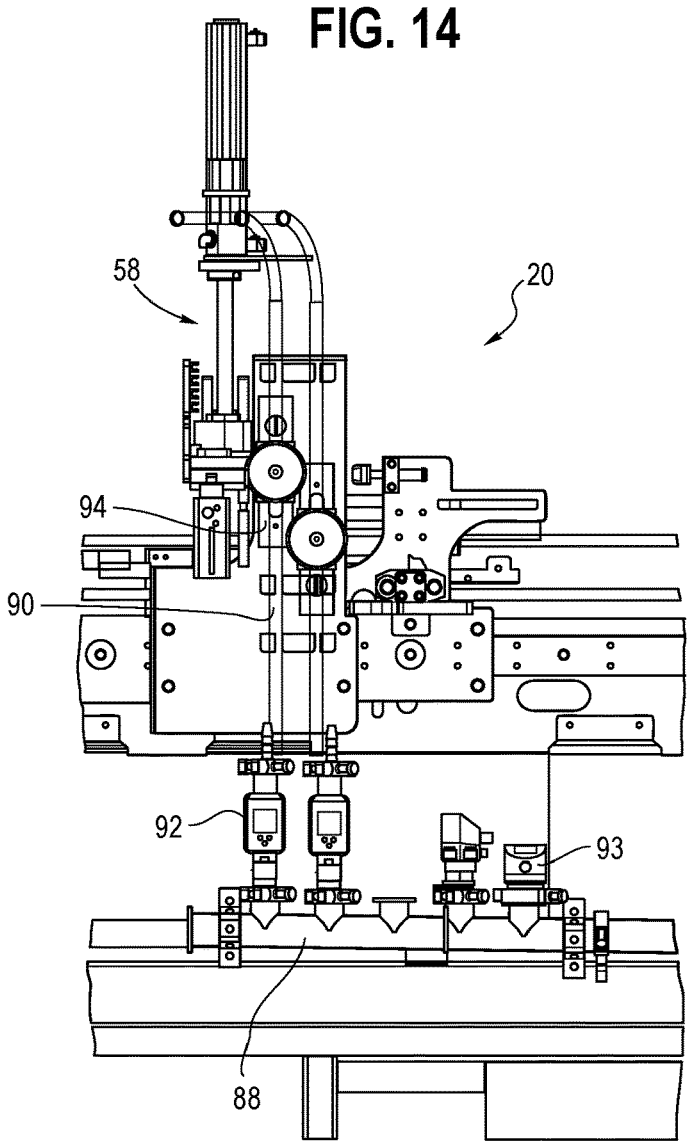
FIG. 14 is a front elevation view of a beverage fill station, featuring a flow control system.
Figure 15:
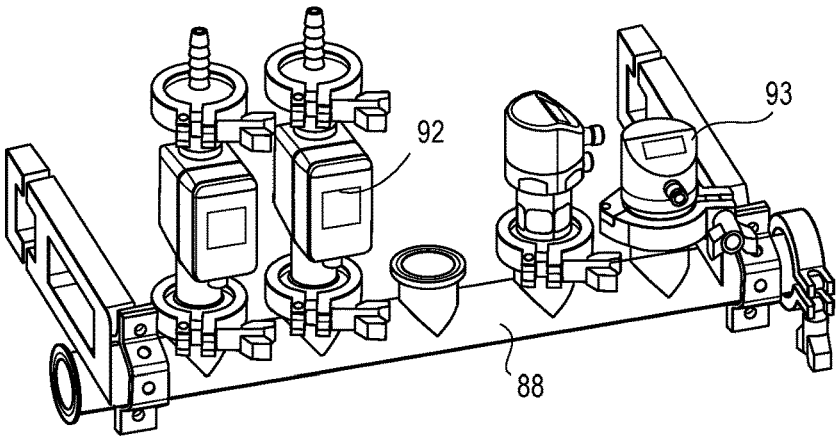
FIG. 15 is a top perspective view of a liquid manifold.

As best visualized on FIGS. 1, 2, and 13-15, a liquid or beverage may be conveyed to the vicinity of the container filling station 10 in a pipeline (not shown) running from a beverage or liquid source and connected to a manifold 88. Outlets from the manifold 88 may be connected with a liquid conduit 90 to the fluid inlet assembly 60 of a filling head 58. The conduit 90 may be implemented with any combination of hoses, tubes, pipes, or other suitable liquid conduits. Any number of connectors, valves, sensors, control modules, or ancillary liquid control apparatus may be positioned along the conduit 90 between the manifold 88 and a fluid inlet assembly 60. For example, as shown in FIGS. 13-15, a beverage or other liquid may flow through a flowmeter 92 and a flow control device 94 prior to entering the fill head 58. In addition, the outlet port valve 74 may be used to further control flow into a container 30.

More specifically, the flowmeter 92 may monitor the quantity of a beverage or liquid flowing from a manifold 88 outlet into a given fill head 58. When a selected quantity of has entered the container 30, electronic communication between the flowmeter 92 and the valve control assembly 80 can cause the outlet port valve 74 to close. Alternatively, an ancillary valve located at any point along the conduit 90 may be caused to close. The signal causing any valve to close may alternatively, or in addition be controlled by a timer or a sensor configured to sense the liquid fill level within a container 30. Appropriate sensors include but are not limited to contact sensors, float sensors, conductivity sensors, pressure sensors, float switches, optical sensors, and the like, as well as a snift tube or other control device. Alternatively, the quantity of beverage or other liquid supplied from the manifold 88 into a container 30 may be manually controlled using one or more valves.

Figure 16:
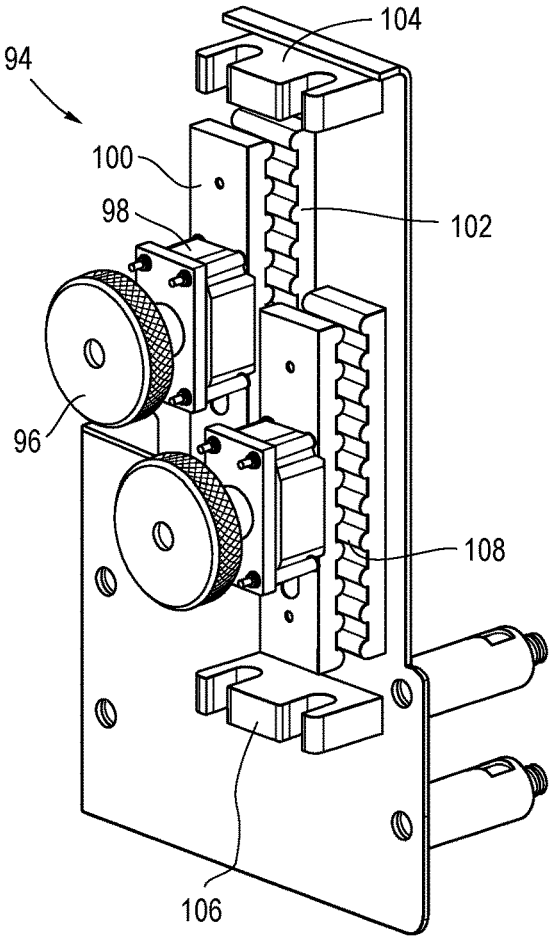
FIG. 16 is a front perspective view of a liquid flow control valve.
Figure 17:
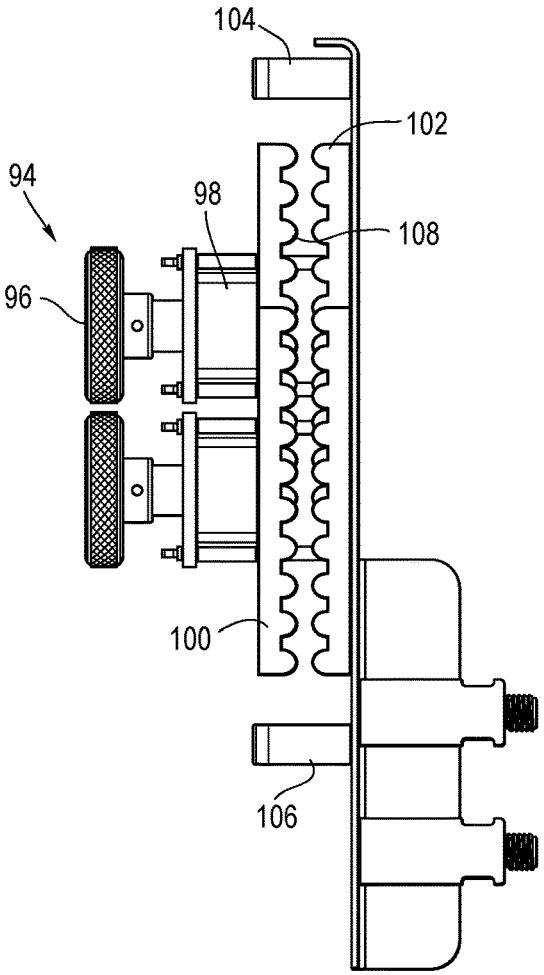
FIG. 17 is a side plan view of the liquid flow control valve of FIG. 16.

In addition to control over the quantity of a beverage or other liquid transported from the manifold 88 to the interior of a container 30, it may be desirable to provide manual or automated control over the rate of flow from the manifold 88 into the container 30. In one embodiment, a flow control device 94 may be manually or automatically operated to control the rate of beverage or liquid flow. A representative flow control device 94 is illustrated in FIGS. 16 and 17.

The flow control device 94 includes a fluid control knob 96 connected to a transmission 98 positioned to move a front pinch clamp 100 toward or away from a rear pinch clamp 102.

As shown in FIG. 14, a flexible portion of the conduit 90 may be received between the front pinch clamp 100 and the rear pinch clamp 102 and secured in place with an upper clip 104 and lower clip 106. When a user manually operates the fluid control knob 96, or when an electronic system operates a corresponding actuator, the transmission 98 or a similar structure drives the front pinch clamp 100 toward the rear pinch clamp 102 constricting the flexible portion of the conduit 90 between the pinch clamps to limit the beverage or liquid flow rate. The flow rate can be increased by reversing this operation. The illustrated pinch clamps 100, 102 have a scalloped surface 108 facing the conduit 90 which enhances the degree of control which may be provided with a pinch valve. Alternative pinch clamp 100, 102 shapes or configurations may be utilized if desired, including flat, multinodal, and/or other single-surface or multisurface contacting configurations, so long as the pinch clamp effectively (mostly or completely) restricts flow through the conduit 90. Furthermore, alternative types of pinch valves, for example the cylindrical pinch valve 110 shown on FIG. 13, may be utilized instead of or in conjunction with the flow control device 94. Liquid flow rate control may alternatively be provided with any combination of manually or electronically controlled gate valves, ball valves, variable sized orifices, pinch valves, independently selectable fixed orifices, or with multiple valves or control assemblies of various types that may include static controls and/or variable controls.

Figure 4:
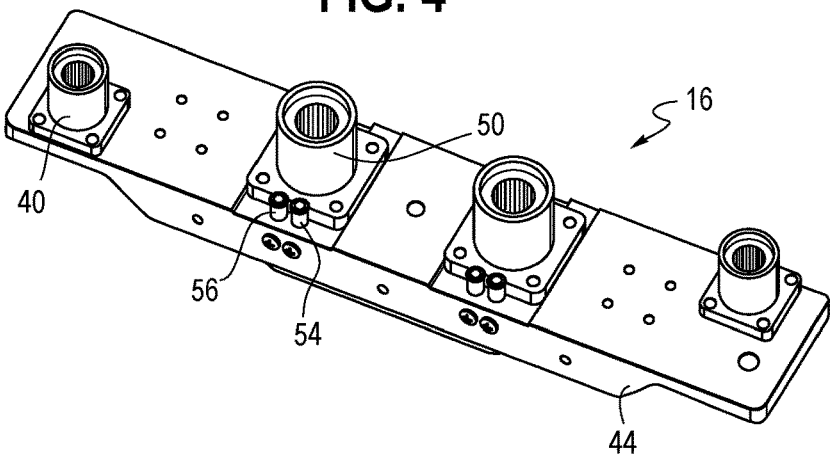
FIG. 4 is a is a top perspective view of the seal bar of FIG. 3.
Figure 5:
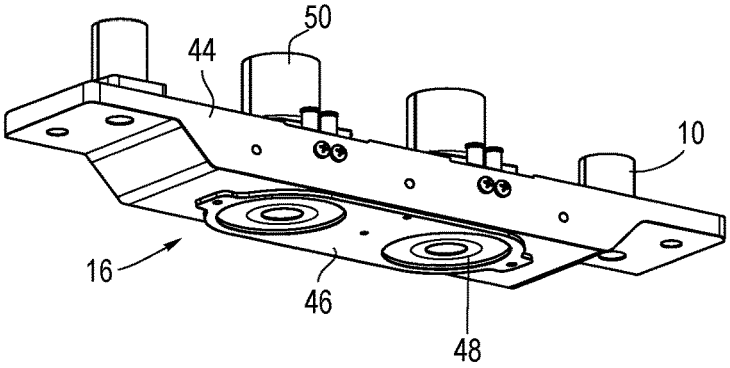
FIG. 5 is a bottom perspective view of the seal bar of FIG. 3.
Figure 18:
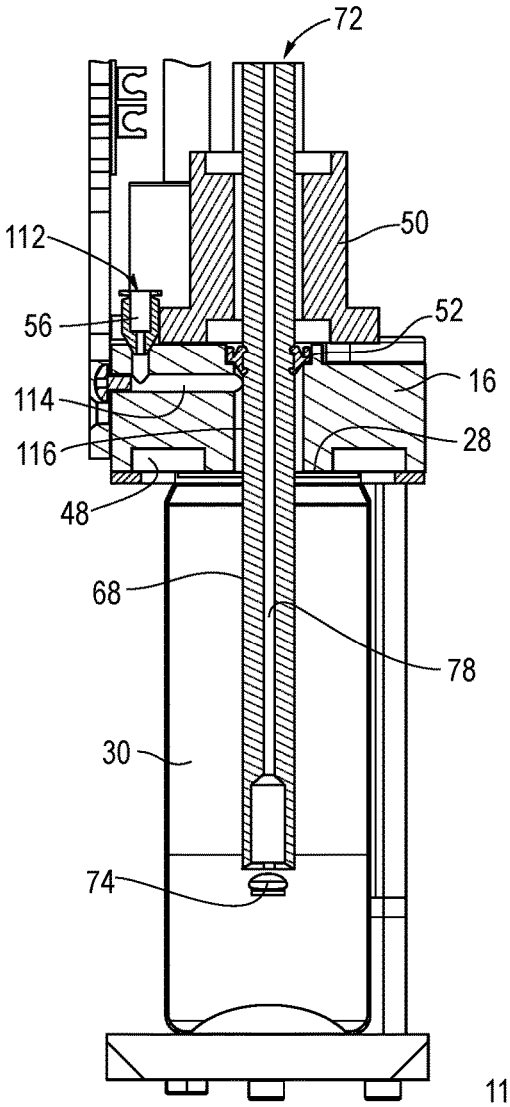
FIG. 18 is a cross-sectional view of a seal bar, portions of a fill head, and a container.
Figure 19:
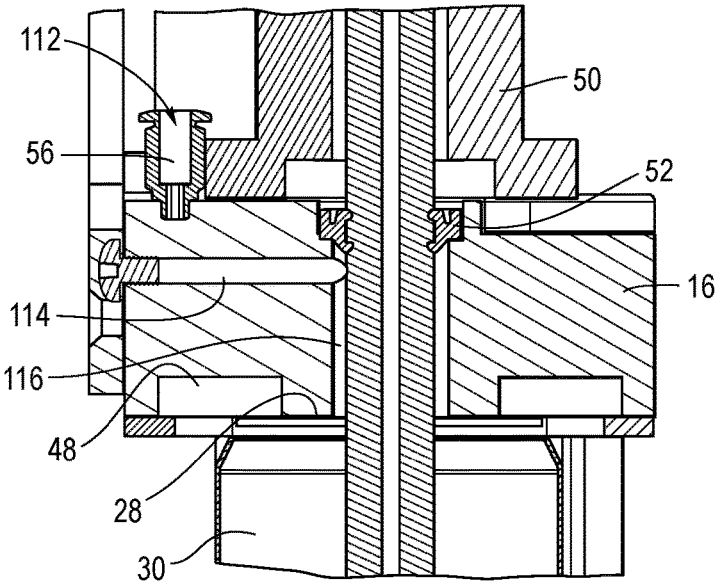
FIG. 19 is an enlarged portion of the cross-sectional view of FIG. 18.
Figure 20:
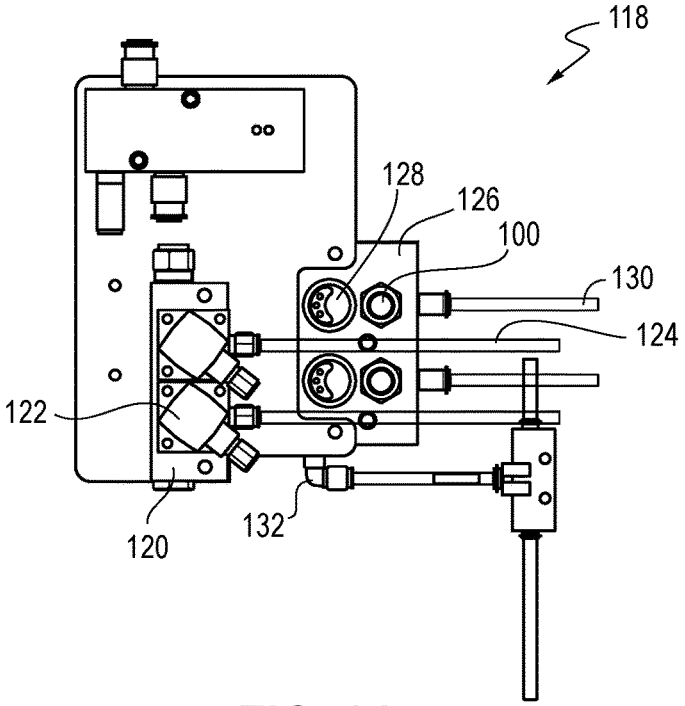
FIG. 20 is a is a plan view of a gas control manifold.
Figure 21:
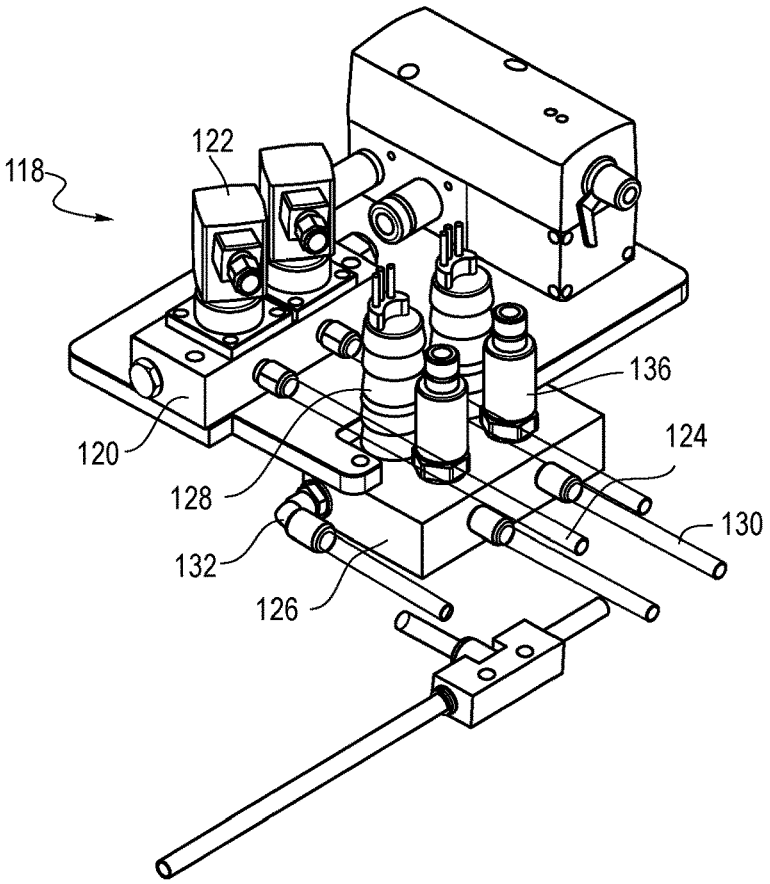
FIG. 21 is a perspective view of the gas control manifold of FIG. 20

As noted above, beverage or liquid flow rates from the manifold 88 and into the interior of a container 30 may also (or alternatively) be controlled by exercising control over the flow of gas displaced from the temporarily sealed container 30 by incoming liquid or beverage during filling operations. As illustrated in FIGS. 3-5, the seal bar body 44 will typically include a one or more gas inlet ports 54 and gas outlet ports 56. FIGS. 18 and 19 are cross-sectional views of portions of a seal bar 16, fill head 58 and container 30 showing a gas pathway 112 in fluid communication with the interior of a container 30 through a gas outlet port 56, a gas conduit 114 and an annular space 116 extending through the seal 48.

FIGS. 20-24 illustrate a representative gas control apparatus 118 that may be connected with tubes or hoses to the outlet ports 54, 56. It is important to note that the flow control system 20 may include both the gas control apparatus 118, and a liquid or beverage flow control apparatus as described above. Alternatively, the flow control system 20 may be implemented with any portion or combination of the described subsystems.

The representative gas control apparatus 118 includes a gas inlet manifold 120 connected to a source of pressurized gas (not shown). If the liquid is a beverage being filled into a container 30 (e.g., a beer or a soft drink), the pressurized gas may be carbon dioxide or nitrogen. A system may be implemented with other gases suitable to the liquid being filled into the container 30. Typically, the pressurized gas supply cylinder will feed into a conventional gas pressure regulator to reduce the pressure of the gas at the inlet to the manifold 120. Then, gas inlet manifold 120 may be manually or electronically operated to further regulate the flow rate and pressure of the gas fed into the interior of a container 30. For example, the gas inlet manifold 120 may have one or more electronic or manually controlled valves 122 feeding one or more gas inlet tubes 124 connected to one or more gas inlet ports 54.

Similarly, the gas manifold apparatus 118 may include a gas outlet manifold 126. As noted above, the flow rate of a beverage or liquid into a temporarily sealed container 30 may be controlled by exercising control over the flow rate of gas exiting the temporarily sealed container 30 as it is displaced by a quantity of beverage or other liquid. The gas outlet manifold 126 is therefore a representative apparatus serving to regulate the rate of gas flowing from the interior of a container 30 during fill operations. To facilitate control over the exit gas flow rate and therefore over the beverage or liquid flow rate, the gas outlet manifold 126 may be provided with one or more control valves, including but not limited to proportional valve 128 in communication with one or more gas outlet tubes 130.

Figure 22:
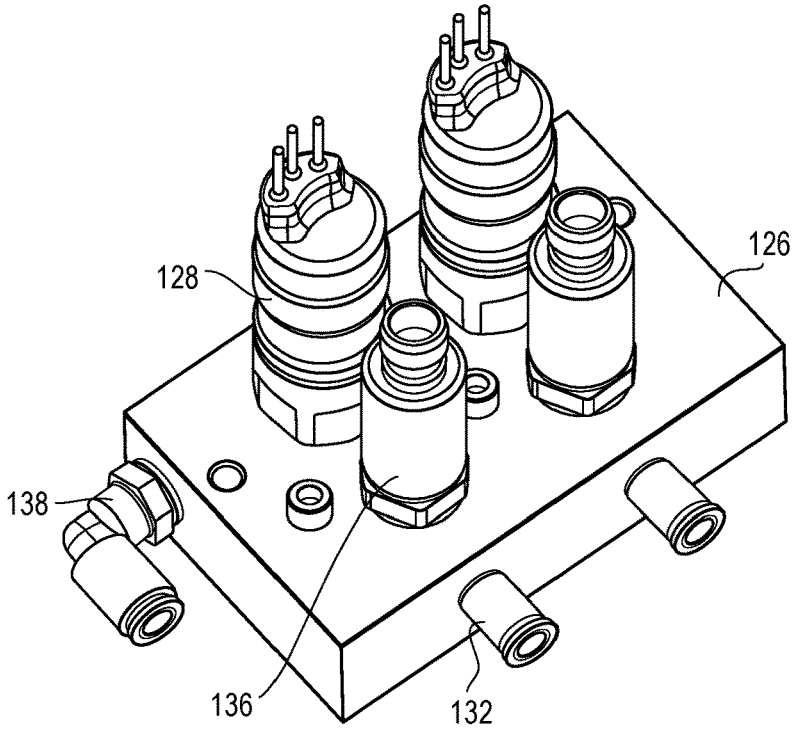
FIG. 22 is a perspective view of a gas outlet manifold.
Figure 23:
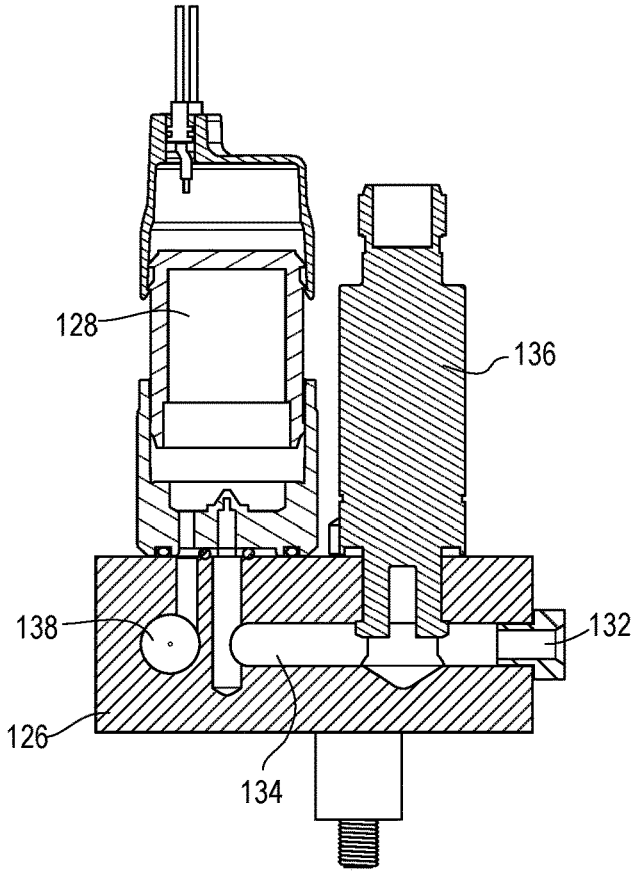
FIG. 23 is a side elevation cross-sectional view of the gas outlet manifold of FIG. 22.
Figure 24:
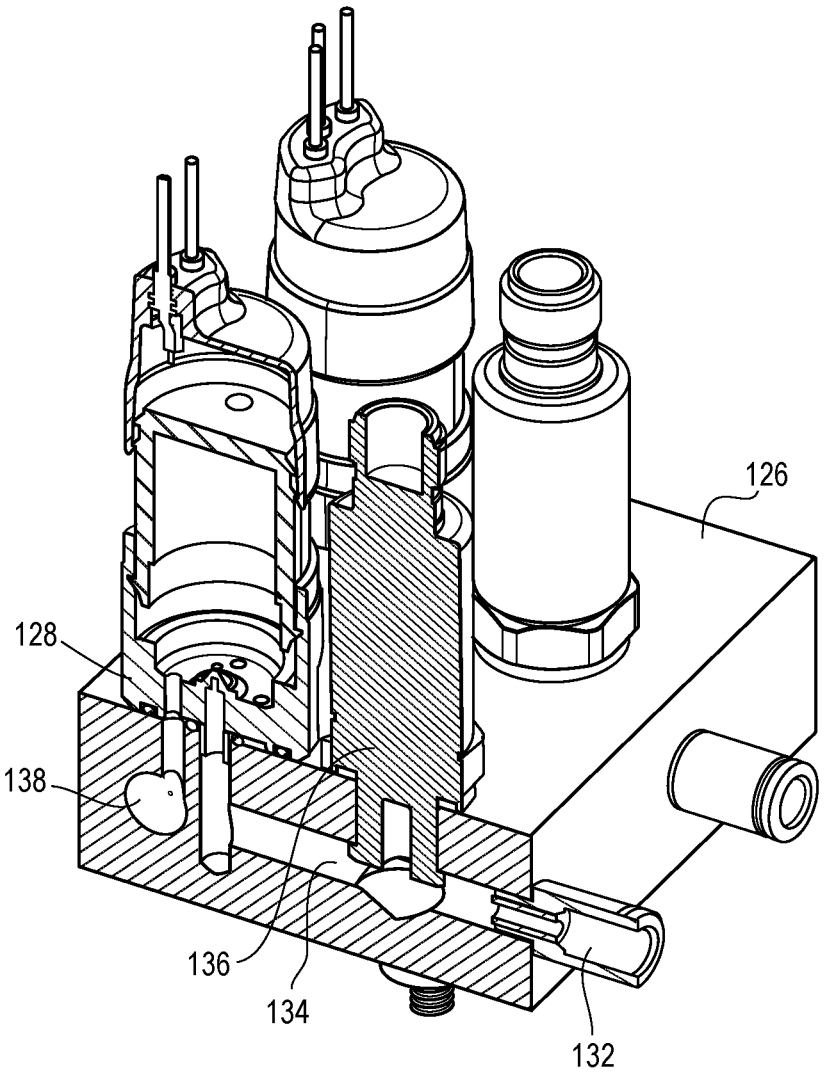
FIG. 24 is a perspective cross-sectional view of the gas outlet manifold of FIG. 22.

Specifically, as shown in FIGS. 22-24, outlet gas exhausted from the interior of a container 30 through a gas outlet port 56 may be communicated to the gas outlet manifold 126 in a gas outlet tube 130 received in an outlet manifold port 132. The flow of gas through manifold conduit 134 may be completely stopped during certain filling operations described in more detail below, with a valve, for example solenoid-controlled valve 136. Downstream from any valve 136, the outlet gas may flow through the electronically controlled proportional valve 128 and be exhausted from the gas outlet manifold 126 through the exhaust port 138 or another structure.

The valve 136 and proportional valve 128 may, in certain embodiments be replaced with a single valve. The illustrated valve 136 and proportional valve 128 are electronically controlled but may in alternative embodiments be manually controlled. In electronically controlled embodiments, input to the valve 136 and proportional valve 128 may be provided from the flow meter 92, a timer, any sensor operatively associated with the seal bar 16 and/or interior space of the container 30 during fill operations.

As noted above, the flow rate of gas exiting the interior space of a container 30 may alternatively be manually controlled. Specifically, fine control over the flow rate of the gas exhausted from the container 30 may be implemented with manual or electronic controls positioned away from the gas inlet manifold 120.

For example, the flow of gas away from the outlet port 56 of the seal bar 16 may be controlled at or near the flow control device 94 illustrated in FIG. 14. A gas flow control valve (not shown) could be provided having substantially identical structure to the flow control device 94, although a gas flow control valve would typically be implemented with smaller components suitable to pinch a relatively small gas outlet tube 130. Thus, a gas flow control valve could be provided having a fluid control knob, transmission, front and rear pinch clamps and if desired scalloped surfaces like those described above with respect to liquid flow control device 94. Alternatively, control over the flow rate of gas exhausted from the interior of the container 30 during fill operations may be accomplished using any combination of electronically or manually controlled alternative valves, variable sized orifices, pinch valves, independently selectable fixed orifices, or with multiple valves of various types.

Figure 25A:
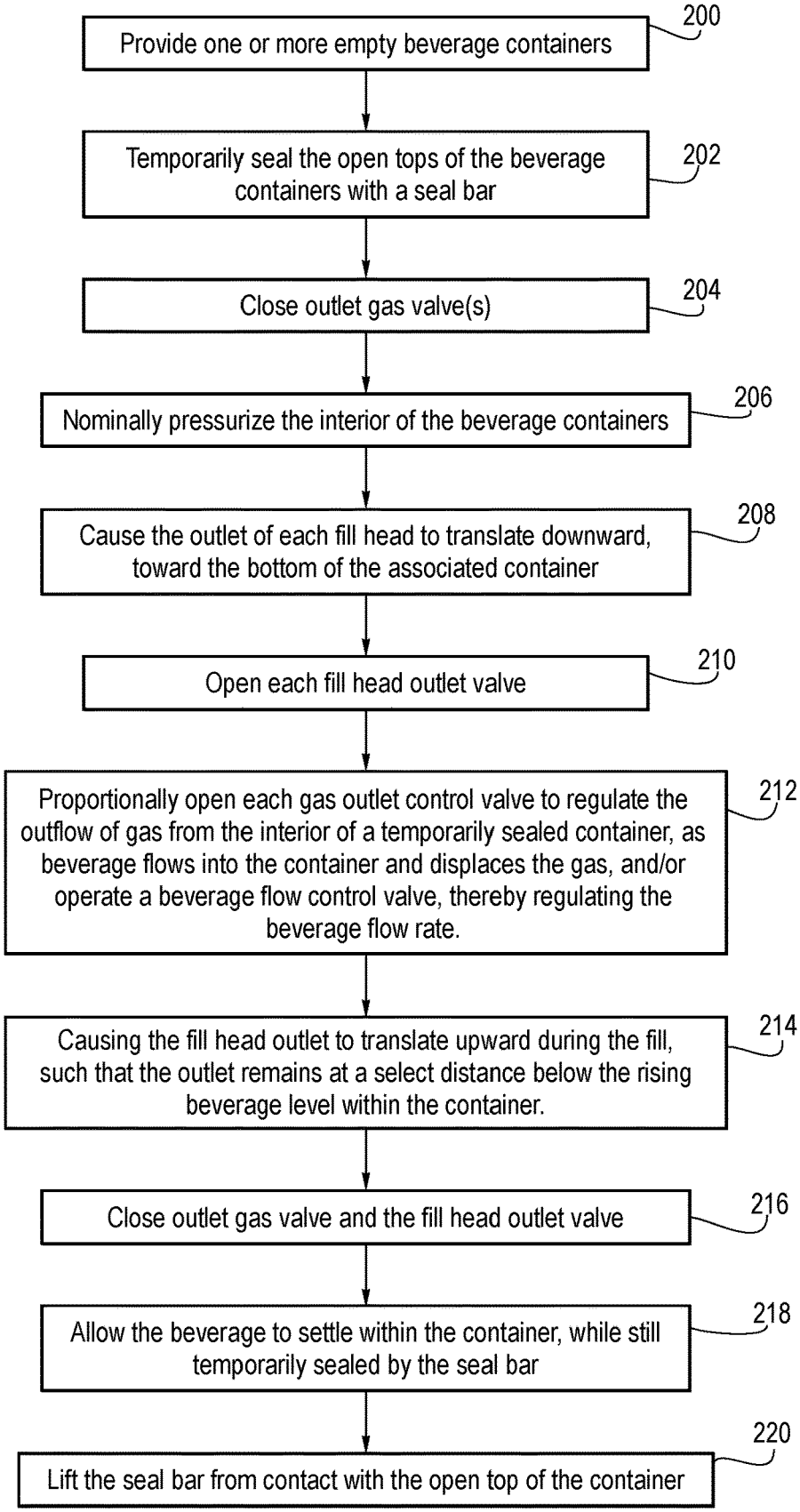
FIGS. 25A-25B are flowchart representations of two methods as disclosed herein.

FIG. 25 is a flowchart illustration of a counterpressure fill method using selected system elements described herein. Although the method is described with respect to a system where two containers 30 are filled substantially simultaneously, similar steps may be implemented with a one container or a multiple container system.

The method begins with two empty containers 30 being placed under the seal bar 16 (step 200). The containers 30 may be placed under the seal bar 16 manually or using any type of conveyor or container transfer apparatus 22. The seal 48 of the seal bar is then brought into contact with the open tops 28 of containers 30 to temporarily seal the containers during the fill process (step 202). The seal 48 is brought into contact with the open tops 28 by manual or electronically controlled operation of the gantry actuator 32. Various ancillary gaskets and seals, including, but not limited to, the gasket 52 associated with the fill head bearing 50 and the valve shaft seal 82 within each fill head 58 assure that the interior space of the containers 30 is substantially sealed from the exterior atmosphere during fill operations. When the interior spaces of the containers 30 are sealed, the solenoid-controlled valve 136 or similar device may be operated to close the gas exhaust path leading from the interior of container 30 to the outside atmosphere (step 204).

When the containers 30 are sealed with the seal bar 16 (during a non-atmospheric pressure/negative pressure filling operation), a quantity of gas, typically but not exclusively carbon dioxide, may be fed from an external gas supply (not shown) through the gas inlet manifold 120, through one or more gas inlet tubes 124 to one or more gas inlet ports 54 opening into the seal bar body 44. In the illustrated embodiment, the interior of each container 30 is in fluid communication with a separate gas inlet port 54. In an alternative embodiment, one gas inlet port may communicate with the interiors of multiple containers through the seal bar body 44. In certain methods of use, a user may define and set nominal desired pressure differential for the container via any human-machine interface (e.g., a graphic user interface on a control screen, knob, dial, or other interface configured to control/direct processes related to monitoring and adjusting for pressure differential between in the container and in the ambient/surrounding environment, and/or between in the container and elsewhere in the device. The incoming product pressure from the product supply vessel is monitored by the manifold pressure sensor 93 at the machine. Gas may be fed into the container 30 to pressurize the interior of the container to a user defined differential below the pressure read by the manifold pressure sensor 93 (step 206).

Before, during, or immediately after pressurization, the fill heads 58 may be caused to translate downward through the respective fill head bearings 50 until the fill head outlets 66 are positioned at or near the bottom of the respective container 30 (step 208). Movement of the fill heads 58 may be accomplished by operation of the fill head actuator 64 as described above. During this operation, the interior of the container 30 becomes or remains sealed from the exterior atmosphere and may be slightly pressurized as described above.

At this point, each fill head outlet valve 74 may be opened (step 210). Alternatively, another valve typically positioned between manifold 88 and a fill head 58 may be opened. Because the system is sealed from the exterior atmosphere in some embodiments, and because flow from the liquid or beverage source is provided by gravity and pressure within the liquid or beverage source, little or no liquid or beverage will flow through each fill head 58 until the solenoid valve 136 or another gas outlet control valve is opened. In certain embodiments, the outlet gas manifold 126 features an electronically controlled proportional valve 128. Therefore, a fine degree of control over the flow rate through each fill head 58 may be exercised by controlling the flow of gas out of the interior of each container 30 by opening and controlling the proportional valve 128 or similar structure as liquid or beverage flows into each container 30 and displaces the gas. Alternatively, or additionally, the liquid or beverage flow rate may be controlled directly using a flow control device 94 or similar device as described above. (step 212).

Figure 25B:
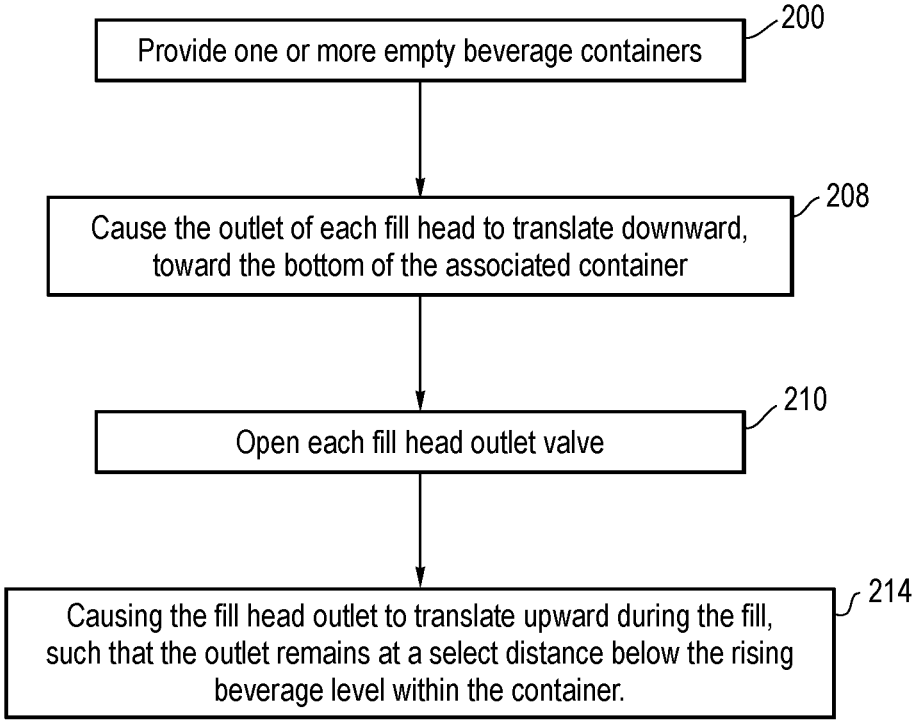

As beverage or another liquid flows into each container 30, each fill head 58 is caused to translate upward by operation of the fill head actuator 64. In this manner, which may be augmented by sensor data, the fill head outlet 66 may be caused remain at a relatively small pre-determined distance below the surface of the liquid as the container 30 is filled (step 214). In some method applications, the beginning, end, and/or complete range of upward motion is defined in the control system, and the rate of the motion is set to correspond with flow control valves. FIG. 25B shows a flowchart illustration of a method using atmospheric pressure without the seal and counterpressure applied, where steps with those measures are not applied, but other aspects are the same and use the same reference numbers and descriptions relative to the drawing figures.

When an appropriate volume of liquid or beverage has been dispensed into each container, the fill head outlet port valve 74, and/or gas valve 136 and or alternative valves may be closed to stop the flow of liquid or beverage into the interior of the container 30 (step 216). It may be desirable to allow the liquid or beverage to settle for a selected settling time while still maintaining the temporary seal provided by the seal bar 16 (step 218). After any desired settling time, the seal bar gantry 18 and gantry actuator 32 may be operated to separate the seal bar from contact with the open top 28 of the container 30 (step 220). The filled container 30 may then be transported away from the container fill station 10 to downstream processes including but not limited to container lid application, container lid seaming (or other sealing action), labeling, and packaging.

The foregoing methods and apparatus provide certain advantages including but not limited to a reduction in dissolved oxygen pickup during the fill process due to sub-surface filling. Advantages also include reduction in overflow or foaming due to the relatively small differential pressure between the interior of the container and the supply during the fill process and due to the controlled flow rate of the liquid or beverage provided by using the proportional valve 128 and/or flow control device 94 or similar systems affecting flow control.

The foregoing methods and apparatus specifically do not require a top-bell counterpressure apparatus, a pressure bowl, any vacuum pump or similar apparatus utilized to implement known counter-pressure fill systems and methods. This provides certain advantages. For example, systems featuring the disclosed apparatus may be produced at a lower cost and with less complex apparatus than a system featuring a top-bell, pressure bowl, or vacuum system. Omitting those structures in the manner of the present disclosure may also reduce waste and/or improve product quality (e.g., by decreasing oxygen exposure) during operation. In addition, the disclosed systems and methods may provide for a faster filling cycle than alternative systems featuring a top-bell or pressure bowl.

Certain steps disclosed above are optional. For example, the step of preliminarily providing a temporary seal over the interior of a container 30 with the seal bar 16 may be eliminated in certain instances where it is desirable to control the flow rate with the flow control device 94 alone. Unsealed filling may be desirable when filling a container with a non-carbonated beverage, for example, as well as independently providing for reduced consumption of $CO_2$, improved speed of cycles, and other advantages.

Having described certain exemplary embodiments, it will be understood by those skilled in the art that many changes in construction and widely differing embodiments and applications of the invention will suggest themselves without departing from the scope of the present invention.

Hence, while various embodiments are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

We claim:

1. A method of filling a container comprising:

temporarily sealing an interior of a container by contacting an open end of the container with a seal bar to form a temporary seal;

moving a fill head through a sealed opening in the seal bar to position a fill head outlet at a starting position within the interior of the container opposite the open end and near or at a bottom of the container;

opening a fill head valve located in a fluid pathway between a liquid source and an outlet from the fill head;

opening an outflowing gas valve in fluid communication with the interior of the container; and controlling a liquid flow rate through the fill head by regulating the gas flow through the outflowing gas valve;

providing an inflowing gas valve in an input gas pathway between a gas source and the interior of the container;

opening the inflowing gas valve to pressurize the interior of the container with a gas from the gas source; and lifting the fill head outlet from the starting position within the interior of the container toward the open end of the container at a rate that causes the fill head outlet to remain a pre-determined distance below a surface of the liquid as the container is filled.

2. The method of claim 1, further comprising:

providing a seal gantry comprising a seal gantry actuator and a guide rod supporting the seal bar; and moving the seal bar into contact with the open end of the container by action of the seal gantry actuator prior to opening the outflowing gas valve;

closing the outflowing gas valve when the container is filled with the liquid; and moving the seal bar out of contact with the open end of the container by action of the seal gantry actuator after the container is filled with the liquid.

3. The method of claim 2 further comprising:

providing a shaft collar on the guide rod; and setting a vertical position of the shaft collar on the guide rod to correspond to a height of the container.

4. The method of claim 2, where pressure in the container is the same as or lower than ambient atmospheric pressure.

5. The method of claim 1, further comprising controlling the liquid flow rate by regulating a liquid flow control valve positioned in the fluid pathway.

6. The method of claim 1, further comprising lifting the fill head from the starting position within the interior of the container toward the open end of the container, while maintaining the temporary seal at the open end of the container.

* * * * *